US009638461B2

(12) United States Patent
Wait et al.

(10) Patent No.: US 9,638,461 B2
(45) Date of Patent: May 2, 2017

(54) METHOD FOR OPERATING A REFRIGERATOR APPLIANCE

(71) Applicant: General Electric Company, Schenectady, NY (US)

(72) Inventors: Keith Wesley Wait, Louisville, KY (US); William Everette Gardner, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 441 days.

(21) Appl. No.: 14/181,772

(22) Filed: Feb. 17, 2014

(65) Prior Publication Data

US 2015/0232320 A1 Aug. 20, 2015

(51) Int. Cl.

| | |
|---|---|
| ***F25D 3/12*** | (2006.01) |
| ***F25D 31/00*** | (2006.01) |
| ***B67D 1/00*** | (2006.01) |
| ***B67D 1/08*** | (2006.01) |
| ***F25D 23/12*** | (2006.01) |

(52) U.S. Cl.

CPC ..... *F25D 31/005* (2013.01); *B67D 1/0014* (2013.01); *B67D 1/0858* (2013.01); *B67D 1/0888* (2013.01); *F25D 23/126* (2013.01); *F25D 2700/04* (2013.01)

(58) Field of Classification Search

CPC .. F25D 31/005; F25D 23/126; F25D 2700/04; B67D 1/0014; B67D 1/0858; B67D 1/0888

See application file for complete search history.

(56) References Cited

U.S. PATENT DOCUMENTS

| | | | | |
|---|---|---|---|---|
| 7,206,559 | B2 | 4/2007 | Meade, II | |
| 7,298,871 | B2 | 11/2007 | Lee et al. | |
| 8,341,029 | B1 | 12/2012 | Ramalingam et al. | |
| 8,515,574 | B2 | 8/2013 | Studor et al. | |
| 2007/0081696 | A1 | 4/2007 | Brennan et al. | |
| 2009/0236333 | A1* | 9/2009 | Ben-Shmuel | H05B 6/6402 219/702 |
| 2009/0293735 | A1* | 12/2009 | Van Dillen | A47J 31/0668 99/295 |
| 2011/0016910 | A1* | 1/2011 | Bak | F25D 29/00 62/449 |
| 2012/0102993 | A1* | 5/2012 | Hortin | F25D 23/126 62/189 |
| 2012/0285986 | A1* | 11/2012 | Irvin | B67D 1/0041 222/1 |
| 2013/0108249 | A1* | 5/2013 | Krause | B67D 3/0022 392/465 |

FOREIGN PATENT DOCUMENTS

| | | |
|---|---|---|
| JP | H11-250346 | 9/1999 |

* cited by examiner

*Primary Examiner* — Patrick M Buechner
(74) *Attorney, Agent, or Firm* — Dority & Manning, P.A.

(57) ABSTRACT

Refrigerator appliances and methods for operating refrigerator appliances are provided. In one embodiment, a method includes detecting a user's presence, associating the user's presence with a heated beverage preference, and initiating heating of a liquid stored in the refrigerator appliance. The detecting step, the associating step and the initiating step are performed by a controller of the refrigerator appliance.

14 Claims, 7 Drawing Sheets

METHOD FOR OPERATING A REFRIGERATOR APPLIANCE

FIELD OF THE INVENTION

The present subject matter relates generally to refrigerator appliances and associated methods, and more particularly for refrigerator appliances and methods which facilitate automated preheating of liquids to be dispensed.

BACKGROUND OF THE INVENTION

Certain refrigerator appliances include a dispenser for directing ice from the refrigerator's ice maker and/or liquid water to the dispenser. A user can activate the dispenser to direct a flow of ice or liquid water into a cup or other container positioned within the dispenser. Liquid water directed to the dispenser is generally chilled or at an ambient temperature.

Further, certain refrigerator appliances can also include features for dispensing heated liquid water. The heated liquid water can be used to make certain beverages, such as coffee or tea. Refrigerators equipped to dispense heated liquid water can assist with making such beverages. Further, in some cases, refrigerator appliances may be equipped to provide single serving beverages using single serving dispensers and heated liquid water.

However, in some cases, users seeking heated water or a single serve beverage from a refrigerator appliance may be required to wait for a relatively longer period than is desirable to obtain such heated water or single serve beverage. For example, currently, water is heated on demand when a user indicates a desired for heated water or a single serve beverage. Such heating can in some cases take up to or longer than 5 minutes. Users may not want to wait for this period of time for heated water to be available.

Accordingly, improved refrigerator appliances and associated methods are desired in the art. In particular, refrigerator appliances and methods which provide improved heating of liquids to be dispensed would be advantageous.

BRIEF DESCRIPTION OF THE INVENTION

In accordance with one embodiment of the present disclosure, a method for operating a refrigerator appliance is disclosed. The method includes detecting a user's presence, associating the user's presence with a heated beverage preference, and initiating heating of a liquid stored in the refrigerator appliance. The detecting step, the associating step and the initiating step are performed by a controller of the refrigerator appliance.

In accordance with another embodiment of the present disclosure, a method for operating a refrigerator appliance is disclosed. The method includes detecting a user's presence, and determining a time associated with the detection of the user's presence. The method further includes associating the user's presence and the time with a heated beverage preference, and storing the heated beverage preference and the time associated with the detection of the user's presence. The detecting step, the determining step and the associating step are performed by a controller of the refrigerator appliance.

In accordance with another embodiment of the present disclosure, a refrigerator appliance is disclosed. The refrigerator appliance includes a cabinet defining a chilled chamber for receiving food or beverage items for storage, the cabinet defining an opening for accessing the chilled chamber, and a door mounted to the cabinet at the opening of the cabinet. The refrigerator appliance further includes a dispensing assembly. The dispensing assembly includes an outlet conduit configured for flowing a liquid therefrom, and a fluid heating assembly disposed between the flow control device and the outlet conduit, the fluid heating assembly including a holding chamber and a heating element disposed in the holding chamber. The refrigerator appliance further includes a controller, the controller operable to detect a user's presence, associate the user's presence with a heated beverage preference, and initiate heating of a liquid stored in the holding chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
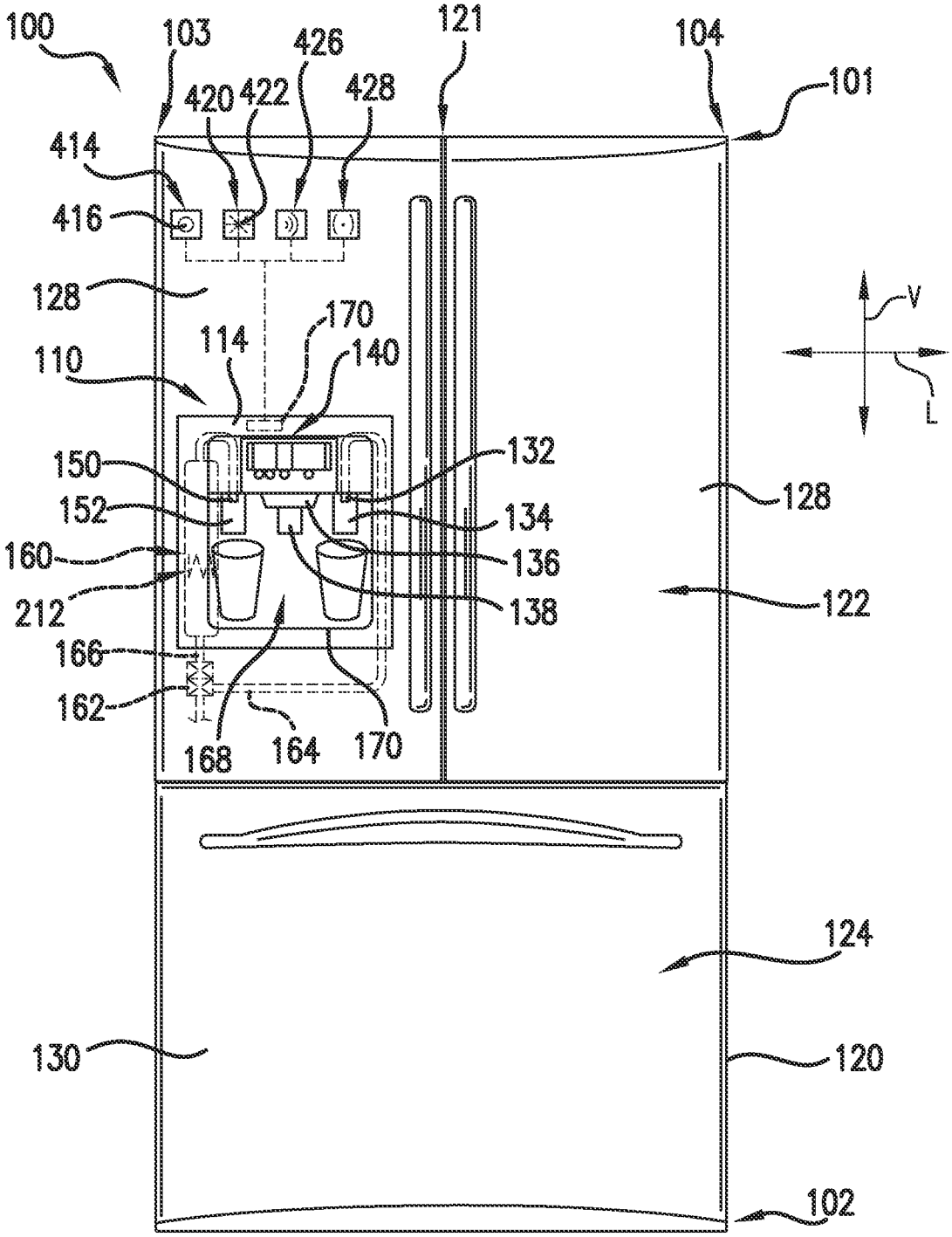
FIG. 1 provides a front, elevation view of an exemplary refrigerator as may be used with the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of a refrigerator appliance 100 according to an exemplary embodiment of the present subject matter. Refrigerator appliance 100 includes a cabinet or housing 120. Housing 120 extends between an upper portion 101 and a lower portion 102 along a vertical direction V and also extends between a first side portion 103 and a second side portion 104 along a lateral direction L. A transverse direction T (see FIG. 2) may additionally be defined perpendicular to the vertical direction and lateral direction L. Housing 120 defines chilled chambers, e.g., a fresh food compartment 122 positioned adjacent upper portion 101 of housing 120 and a freezer compartment 124 arranged at lower portion 102 of housing 120. Housing 120 also defines a mechanical compartment (not shown) for receipt of a sealed cooling system for cooling fresh food compartment 122 and freezer compartment 124.

Refrigerator appliance 100 is generally referred to as a bottom mount refrigerator appliance. However, it should be understood that refrigerator appliance 100 is provided by way of example only. Thus, the present subject matter is not limited to refrigerator appliance 100 and may be utilized in any suitable refrigerator appliance. For example, one of skill in the art will understand that the present subject matter may be used with side-by-side style refrigerator appliances or top mount refrigerator appliances as well.

Refrigerator doors 128 are rotatably hinged housing 120, e.g., at an opening 121 that permits access to fresh food compartment 122, in order to permit selective access to fresh food compartment 122. A freezer door 130 is arranged below refrigerator doors 128 for accessing freezer compartment 124. Freezer door 130 is mounted to a freezer drawer (not shown) slidably coupled within freezer compartment 124.

Refrigerator appliance 100 may also include a dispensing assembly 110 for dispensing various fluids, such as liquid water and/or ice to, for example, a dispenser recess 168 defined on one of refrigerator doors 128. Dispensing assembly 110 includes a dispenser 114 positioned on an exterior portion of refrigerator appliance 100. Dispenser 114 includes several outlets for accessing ice, chilled liquid water, and heated liquid water. As will be understood by those skilled in the art, liquid water from a water source, such as a well or municipal water system, can contain additional substances or matter. Thus, as used herein, the term "water" includes purified water and solutions or mixtures containing water and, e.g., elements (such as calcium, chlorine, and fluorine), salts, bacteria, nitrates, organics, flavor additives and other chemical compounds or substances.

To access ice, chilled liquid water, and heated liquid water, water-dispensing assembly 110 may for example include a chilled water paddle 134 mounted below a chilled water outlet 132 for accessing chilled liquid water and a heated water paddle 152 mounted below a heated water outlet 150 for accessing heated liquid water. Similarly, an ice paddle 138 is mounted below an ice outlet 136 for accessing ice. As an example, a user can urge a vessel such as a cup against any of chilled water paddle 134, heated water paddle 152, and/or ice paddle 138 to initiate a flow of chilled liquid water, heated liquid water, and/or ice into the vessel within dispenser recess 168, respectively.

A control panel or user interface panel 140 may be provided for controlling the mode of operation of dispenser 114, e.g., for selecting crushed or whole ice. In additional exemplary embodiments, refrigerator appliance 100 may include a single outlet and paddle rather than three separate paddles and dispensers. In such embodiments, user interface panel 140 can include a chilled water dispensing button (not labeled), an ice-dispensing button (not labeled), a heated water dispensing button (not labeled), and a steam-dispensing button (not labeled) for selecting between chilled liquid water, ice, heated liquid water, and steam, respectively.

Outlets 132, 136, and 150 and paddles 134, 138, and 152 may be an external part of dispenser 114, and are positioned at or adjacent dispenser recess 168, e.g., a concave portion defined in an outside surface of refrigerator door 128. Dispenser 114 is positioned at a predetermined elevation convenient for a user to access ice or liquid water, e.g., enabling the user to access ice without the need to bend-over and without the need to access freezer compartment 124. In the exemplary embodiment, dispenser 114 is positioned at a level that approximates the chest level of a user.

Refrigerator appliance 100 may also include features for generating heated liquid water and/or steam and directing such heated liquid water and/or steam to, for example, dispenser recess 168. Thus, refrigerator appliance 100 need not be connected to a residential hot water heating system in order to supply heated liquid water and/or steam to dispenser recess 168. In particular, refrigerator appliance 100 includes a fluid heating assembly 160 which may for example be mounted within refrigerator door 128 for heating water therein. Refrigerator appliance 100 may include a tee-joint 162 for splitting a flow of water. Tee-joint 162 directs water to both a heated water conduit 166 and a chilled water conduit 164.

Heated water conduit 166 is in fluid communication with fluid heating assembly 160 and heated water outlet 150. Thus, water from tee joint 162 can pass through fluid heating assembly 160 and exit refrigerator appliance 100 at heated water outlet 150 as heated liquid water or steam. Conversely, chilled water conduit 164 is in fluid communication with chilled water outlet 132. Thus, water from tee-joint 162 can exit refrigerator appliance 100 as chilled liquid water at chilled water outlet 132. In alternative exemplary embodiments, chilled water conduit 164 and heated water conduit 166 are joined such that chilled and heated water conduits 164 and 166 are connected in parallel or in series to each other and dispense fluid at dispenser recess 168 from a common outlet.

Operation of the refrigerator appliance 100 can be regulated by a controller 170 that is operatively coupled to user interface panel 138 and/or various sensors as discussed below. User interface panel 138 provides selections for user manipulation of the operation of refrigerator appliance 100 such as e.g., selections between whole or crushed ice, chilled water, and/or other various options. In response to user manipulation of the user interface panel 138 or sensor signals, controller 170 may operate various components of the refrigerator appliance 100. Controller 170 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 170 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 170 may be positioned in a variety of locations throughout refrigerator appliance 100. In the illustrated embodiment, controller 170 is located within the user interface panel 138. In other embodiments, the controller 170 may be positioned at any suitable location within refrigerator appliance 100, such as for example within a fresh food chamber, a freezer door, etc. Input/output ("I/O") signals may be routed between controller 170 and various operational components of refrigerator appliance 100. For example, user interface panel 138 may be in communication with controller 170 via one or more signal lines or shared communication busses.

Figure 2:
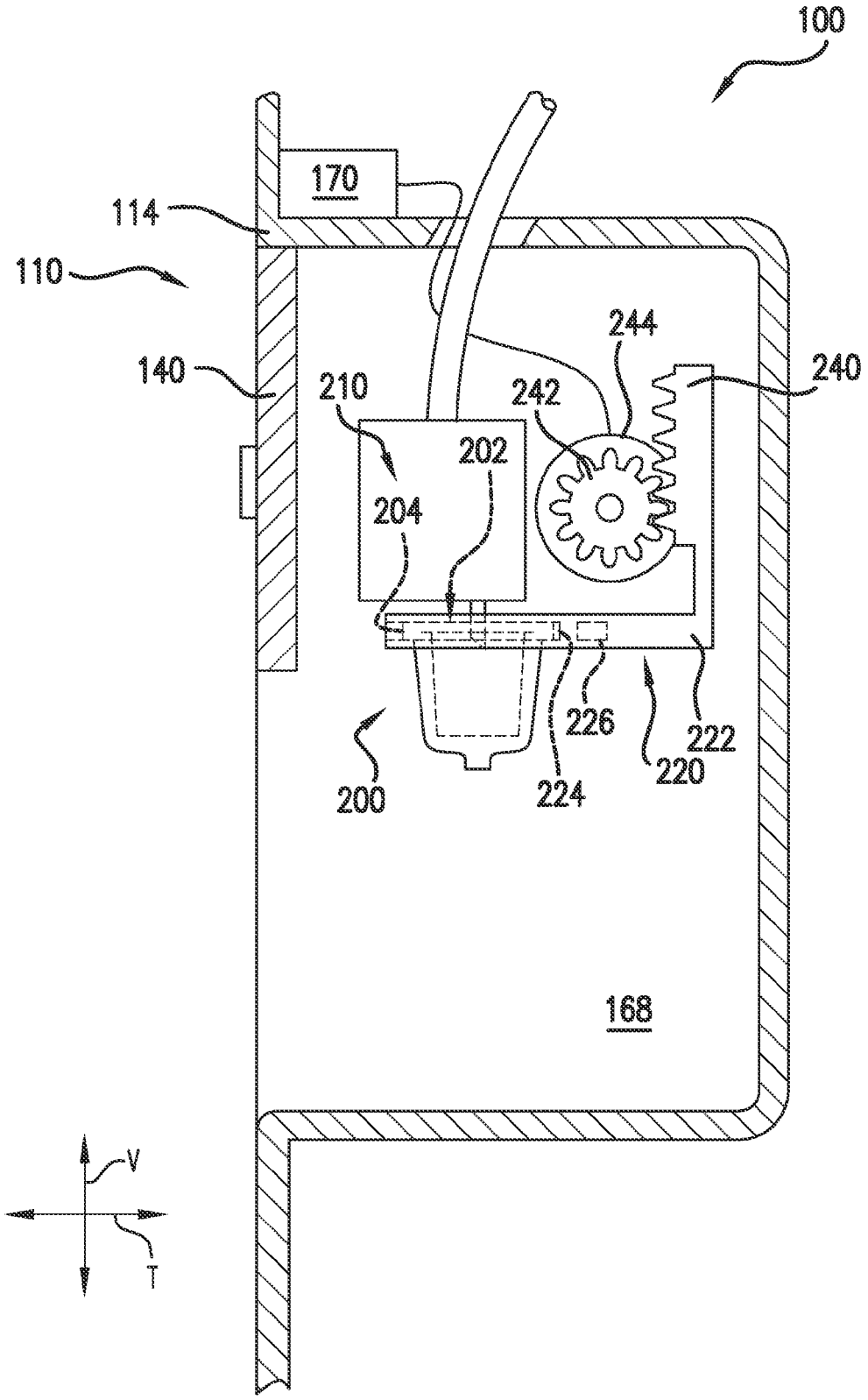
FIG. 2 illustrates a dispensing assembly of a refrigerator apparatus according to one embodiment of the present disclosure.
Figure 3:
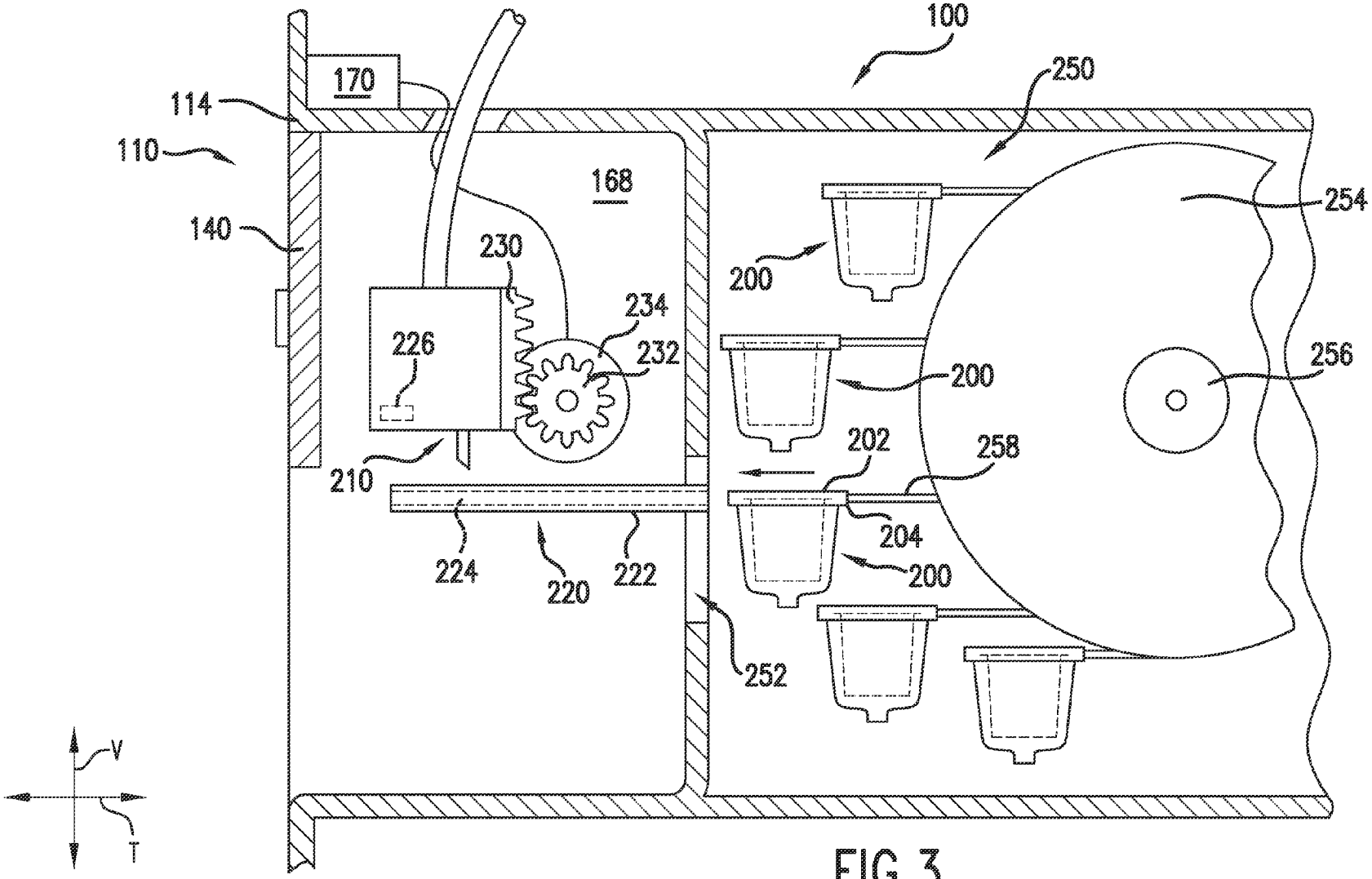
FIG. 3 illustrates a dispensing assembly of a refrigerator apparatus according to another embodiment of the present disclosure.

Referring now to FIGS. 2 and 3, further embodiments of a dispensing assembly 110 are illustrated. In these embodiments, refrigerator appliance 100 may be utilized with single serve dispensers 200. A single serve dispenser 200 is generally a container which contains a predetermined amount of a substance to be mixed with a suitable liquid, such as water, etc. For example, coffee, tea, chocolate, or other suitable consumable or non-consumable substances may be contained within the dispenser 200. A top cover 202 may enclose an opening of the container, and may be puncturable and/or removable to access the substance therein. For example, in some embodiments, the top cover 202 may be formed from a suitable foil material, such as aluminum foil. Dispenser 200 may additionally include a lip 204, which may facilitate placing the dispenser in a housing, as discussed below, such as by sliding the dispenser into the housing. A liquid may then be introduced into the dispenser 200, and the liquid and substance may then flow from the dispenser 200 into, for example, a container (not shown) typically placed below the dispenser 200.

As shown, a dispensing assembly 110 may include an outlet conduit 210. The outlet conduit 210 may be configured for flowing a liquid therefrom. In some embodiments, for example, outlet conduit 210 may be a portion of heated water conduit 166, such as heated water outlet 150, or a portion of chilled water conduit 164, such as chilled water outlet 132. Alternatively, the outlet conduit 210 may be independent from such conduits. The outlet conduit 210 may be disposed in the dispenser recess 168, as illustrated.

The outlet conduit 210 may flow a heated liquid, such as heated water, therethrough. For example, as discussed above, water can pass through a fluid heating assembly 160 and be heated therein, such that it flows from outlet conduit 210 as heated liquid water or steam. Thus, dispensing assembly 110 may include a heating element 212, which may for example be disposed in fluid heating assembly 160 as illustrated, for heating the fluid before the fluid is flowed from the outlet conduit 210.

As further illustrated, a housing 220 may be provided for supporting the single serve dispenser 200. The housing 220 may also be disposed in the dispenser recess 168, as shown. The housing 220 may, for example, include a platform 222 which defines a recess 224 therein, into which a single serve dispenser 200 may be placed. For example, the lip 204 of a dispenser 200 may be slid into the recess 224, and the remainder of the dispenser 200 may generally hang from the platform 222. In some embodiments, various sidewalls may additionally be included in the housing 220, and may extend from the platform 222 to surround the dispenser 200 on various sides.

In some embodiments, as illustrated in FIG. 2, a user may place a single serve dispenser 200 into a platform 222. FIG. 2 illustrates recess 224 defined in a front portion (along the transverse direction T) of the platform 222, which allows users to for example slide a dispenser 200 into the platform 222 as desired. In other embodiments, as illustrated in FIG. 3, the refrigerator appliance 100 may include components for placing single serve dispensers 200 into platforms 222. For example, as illustrated, dispensing assembly 110 may include a dispenser housing 250 which may, for example, be defined in a door 128. Housing 250 may be in communication with platform 222, such as through an access window 252 of the housing 250 that is defined for example in the dispenser 114. A plurality of single serve dispensers 200 may be disposed in the housing 250. The dispensers 200 disposed in housing 250 may have different flavors, etc. as desired. Further, a movable carriage 254 may be included in the housing 250, in which the dispensers 200 may be loaded. Movable carriage 254 may, for example, be a rotating carousel, as illustrated, and may for example, be driven be a motor 256. Motor 256 may be in communication with the controller 170 and thus with the user interface panel 140. A user may, for example, select on user interface panel 140 a desired heated beverage preference. The movable carriage 254 may be movable such that a single serve dispenser 200 corresponding with the user's heated beverage preference is aligned for placement in the platform 222, such as sliding through the access window 252 into the recess 224. An arm 258 of the carriage 254 may further place, such as slide, the desired dispenser 200 into the platform 222 for use. Arm 258 may, for example, be or include a pneumatic or hydraulic cylinder, a geared and/or motorized member, or any other suitable deployable and retractable component suitable for placing a dispenser 200 on a platform 222.

Additionally, in some embodiments, user interface panel 140 may further define the dispenser recess 168. As shown, panel 140 may for example extend from the dispenser 114, such as in the generally vertical direction V, such that a portion of the recess 168 is defined behind the panel 140. Additionally, panel 140 may serve to hide various other components, such as the outlet conduit 210, housing 220, and/or various components thereof in various positions as discussed herein. For example, from a point-of-view in the transverse direction T, a user may view the panel 140 but not be able to see such components hidden behind the panel 140 when in various positions, as discussed herein.

In some embodiments, one or both of the outlet conduit 210 and housing 220 according to the present disclosure are movable. Specifically, as shown, one or both of the outlet conduit 210 and housing 220 may be movable along a direction towards (and conversely away from) the other of the outlet conduit 210 and housing 220. Such movement in exemplary embodiments may along the generally vertical direction V. Such movement may facilitate use of the single serve dispenser 200 by allowing the dispenser 200 to be loaded in the housing 220 and then provided with liquid from the outlet conduit 210. For example, such movement may bring the outlet conduit 210 and dispenser 200 in contact, such that for example the outlet conduit 210 may puncture or otherwise penetrate the top cover 202. Fluid may then be flowed from the outlet conduit 210 into the dispenser 200 as required. In general, outlet conduit 210 and single serve dispenser 200 may be in contact when liquid is flowing from outlet conduit 210, such as into single serve dispenser 200.

FIG. 2 illustrates one embodiment of the present disclosure, wherein the housing 220 is movable. As shown, housing 220 in these embodiments may include a rack 240, and a mating pinion gear 242 mounted to a motor 244 which in turn is in communication with the controller 170 may be provided. Operation of the motor 244 via commands from the controller 170 may move the housing 220 as desired. FIG. 3 illustrates another embodiment wherein the outlet conduit 210 is movable. As shown, outlet conduit 210 in these embodiments may include a rack 230, and a mating pinion gear 232 mounted to a motor 234 which in turn is in communication with the controller 170 may be provided. Operation of the motor 234 via commands from the controller 170 may move the outlet conduit 210 as desired. In alternative embodiments, both the housing 220 and outlet conduit 210 may be movable. It should be understood that the present disclosure is not limited to such rack-and-pinion embodiments, and rather that any suitable mechanical apparatus may be utilized to facilitate movement of the housing 220 and/or outlet conduit 210.

Controller 170 may be in communication with one or both of the outlet conduit 210 and housing 220, and may be operable to move the one or both of the outlet conduit 210 and housing 220 as desired, such as along the generally vertical direction. For example, in some embodiments, the controller 170 may be operable to cause such movement based on a user input, such as via a user interacting with user interface panel 140. Additionally or alternatively, the controller 170 may be automatically operable based on sensing of a dispenser 200 supported on the housing 220. A sensor 226 may be provided for sensing whether a dispenser 200 is disposed in the housing 220. Sensor 226 may in some embodiments as shown be included in outlet conduit 210 or housing 220. One or both of the outlet conduit 210 and housing may be initially moved away from each other, to for example allow for loading of a dispenser 200 in the housing 220. When a dispenser 200 is placed in the housing 220, for example, the sensor 226 may detect the presence of the dispenser 200 and communicate this to the controller 170, which may instruct one or both of the outlet conduit 210 and housing 220 to move towards each other, to for example bring the outlet conduit 210 and dispenser 200 in contact. Further, when the outlet conduit 210 has for example completed the liquid flow therethrough into the dispenser 200, the controller 170, sensor 226 or another suitable sensor (such as a sensor connected to the outlet conduit 210) may detect such completion. This may be communicated to the controller 170 and/or the controller 170 may instruct one or both of the outlet conduit 210 and housing 220 to move away from other, to for example allow for removal of the dispenser 200 from the housing 220. When a dispenser 200 is removed from the housing 220, for example, the sensor 226 may detect the absence of the dispenser 200 and communicate this to the controller 170, which may instruct one or both of the outlet conduit 210 and housing 220 to move towards each other, to for example retract the outlet conduit 210 and/or housing 220 such that they are, for example, not visible. Alternatively, such various movements may be performed due to a user selecting various user inputs on the user interface panel 140.

It should be understood that the various movements of the various components as discussed herein may be performed based on user input and/or performed automatically. For example, all steps may be performed via user input, or automatically, or through a combination of user inputs and automatic steps. In one exemplary embodiment, for example, a user input facilitates an initial movement before or after a dispenser 200 is placed on a housing 220 and the remaining movements are performed automatically.

Figure 4:
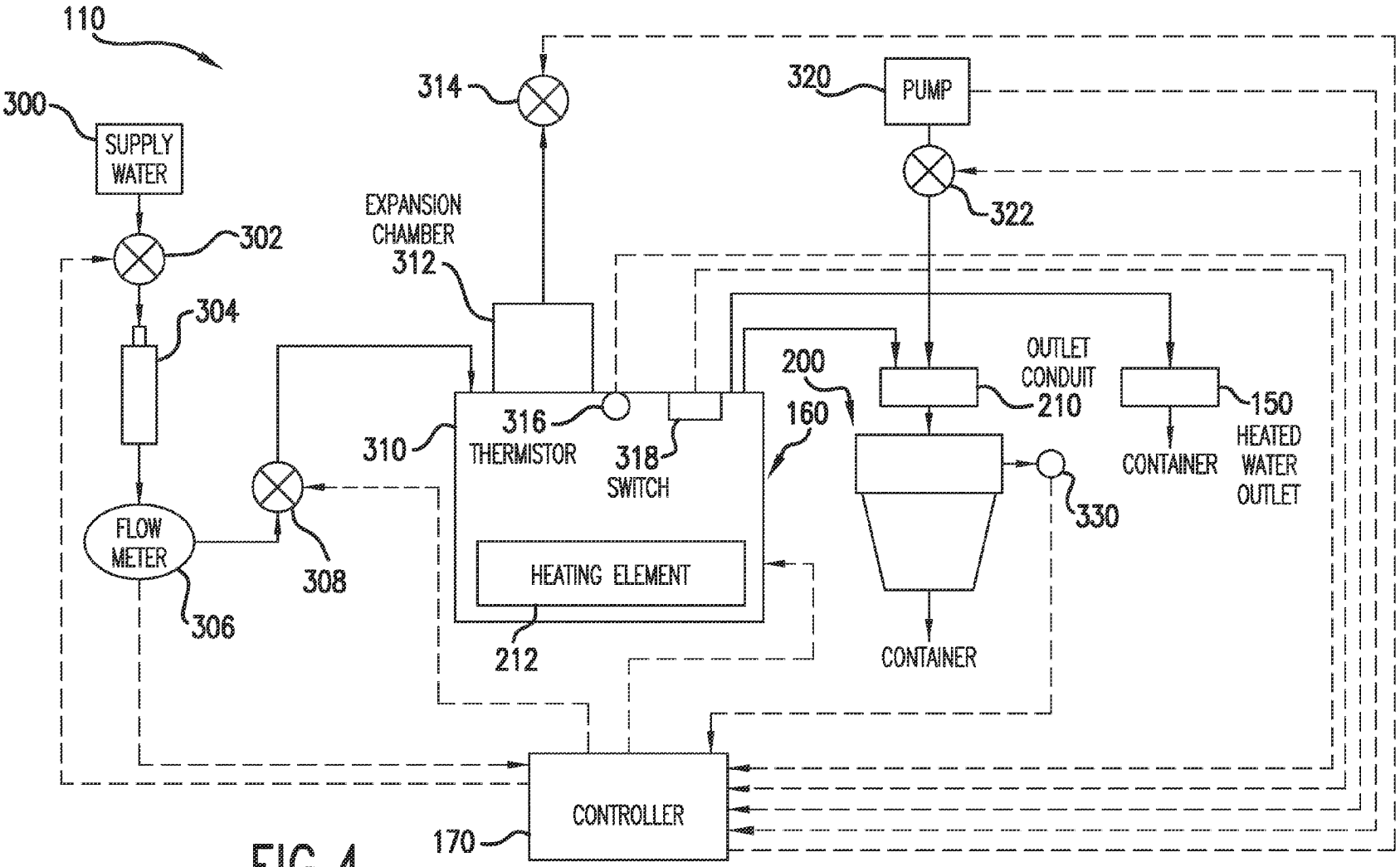
FIG. 4 illustrates a schematic view of a dispensing assembly according to one embodiment of the present disclosure.

FIG. 4 is a schematic illustration of one embodiment of various components of dispensing assembly 110. As discussed, dispensing assembly 110 may include an outlet conduit 210 through which liquid flows into dispenser 200. Various additional components may be provided to facilitate the flow of liquid into and through the outlet conduit 210. Such components may variously be disposed in, for example, the dispenser 114, a door 128, 130, or another suitable location in the refrigerator appliance 100.

As shown, liquid may be supplied from a liquid source 300 through valve 302, such as an isolation valve, to a filter 304. The liquid may be filtered in the filter 304, and then flowed through a flow meter 306. One or more supply valves 308 may then control flow of the liquid to a fluid heating assembly 160. For example, when actuated to an open position, such as by controller 170, liquid may flow through supply valve 308 to fluid heating assembly 160.

Fluid heating assembly 160 may be disposed upstream of the outlet conduit 210 and/or heated water outlet 150. Assembly 160 may, for example, include a holding chamber 310, in which heating element 212 is disposed for heating liquid in the holding chamber 310. Holding chamber 310 generally holds liquid for heating and dispensing therefrom. An expansion chamber 312 may be coupled to the holding chamber 310 to, for example, allow gas generated due to fluid heating in the holding chamber 310 as well as overflow liquid to flow into the expansion chamber 312. A vent valve 314 may allow such gas to escape from the expansion chamber 312. Holding chamber 310 may additionally include, for example, a thermistor 316 and a float or level switch 318, which may govern the level and supply of liquid.

Further, a gas pump 320 may be provided. Gas pump 320 may selectively flow gas through the outlet conduit 210 to a single serve dispenser 200, such as after liquid has been flowed to and through the dispenser 200, to evacuate remaining liquid from the dispenser 200. A gas valve 322 may allow such gas to be provided to the outlet conduit 210.

Liquid may thus be provided to outlet conduit 210 and/or heated water outlet 150 as desired via the various other components of dispensing assembly 110. Liquid may be supplied from the supply valve 308 and fluid heating assembly 160 to outlet conduit 210 and into and through single serve dispensers 200 to a user's container, and/or to heated water outlet 150 and to a user's container. Switches 330, 332 which may for example be mounted on housing 220, and/or sensors 226 may be activated by dispensers 200 to indicate that a supply of liquid is required through outlet conduit 210 and/or heated water outlet 150.

As illustrated, controller 170 may be in communication with the various components of dispensing assembly 110, and may control operation of the various components. For example, the various valves, switches, etc. may be actuatable based on commands from the controller 170. As discussed, interface panel 140 may additionally be in communication with the controller 170. Thus, the various operations may occur based on user input or automatically through controller 170 instruction.

As discussed, improvements in the heating of liquids, such as water, for dispensing from a refrigerator appliance 100 are desired in the art. Accordingly, the present disclosure is further directed to methods and apparatus which advantageously facilitate such improved preheating. For example, such methods and apparatus advantageously provide at least partially automated preheating of liquids contained in the fluid heating assembly 160, such as in the holding chamber 310 thereof, based on the presence of individual users. Such methods and apparatus further advantageously provide for storing of various characteristics associated with individual users, to facilitate automated preheating based on these characteristics.

Figure 5:
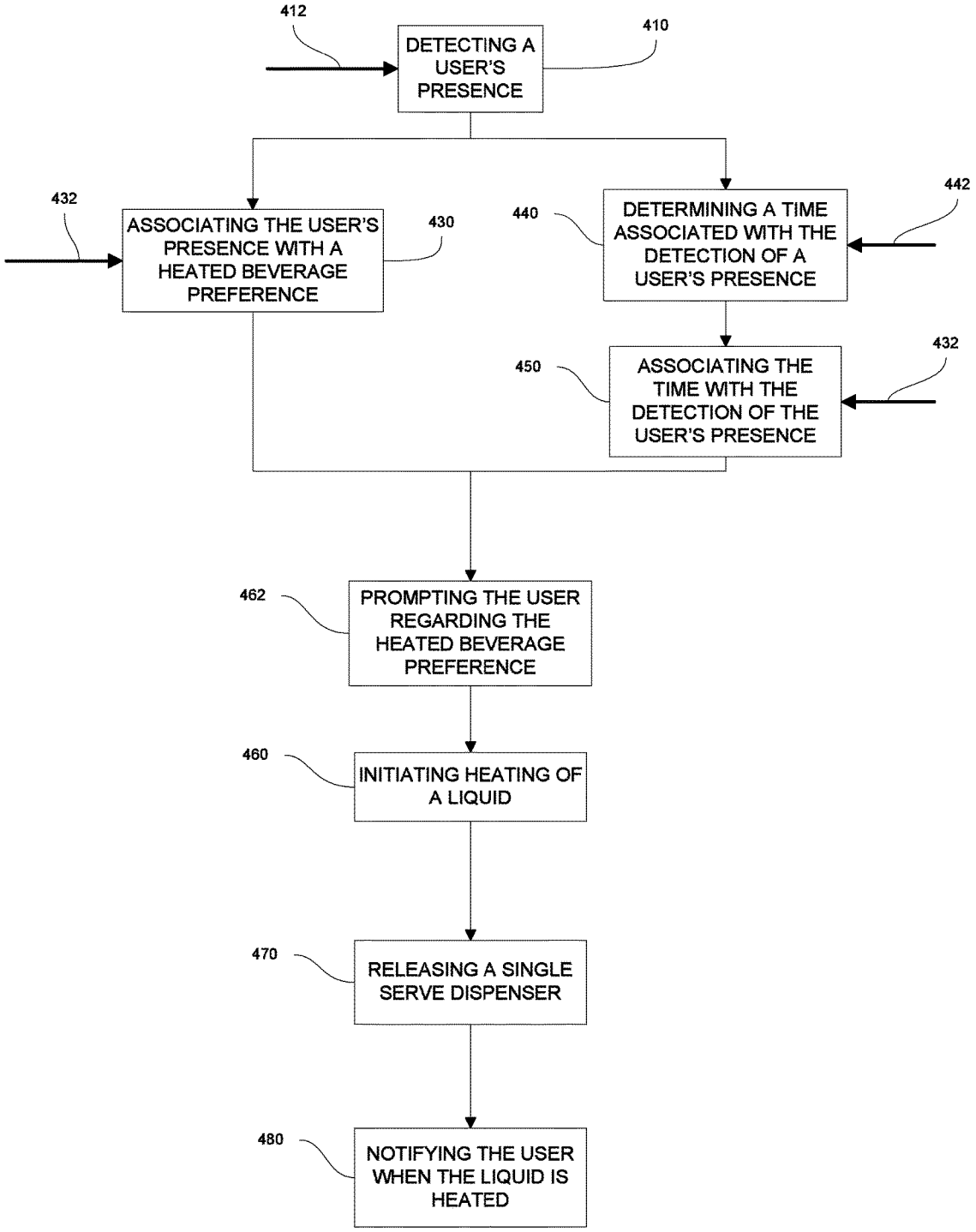
FIG. 5 is a flow chart of a method in accordance with one embodiment of the present disclosure.
Figure 6:
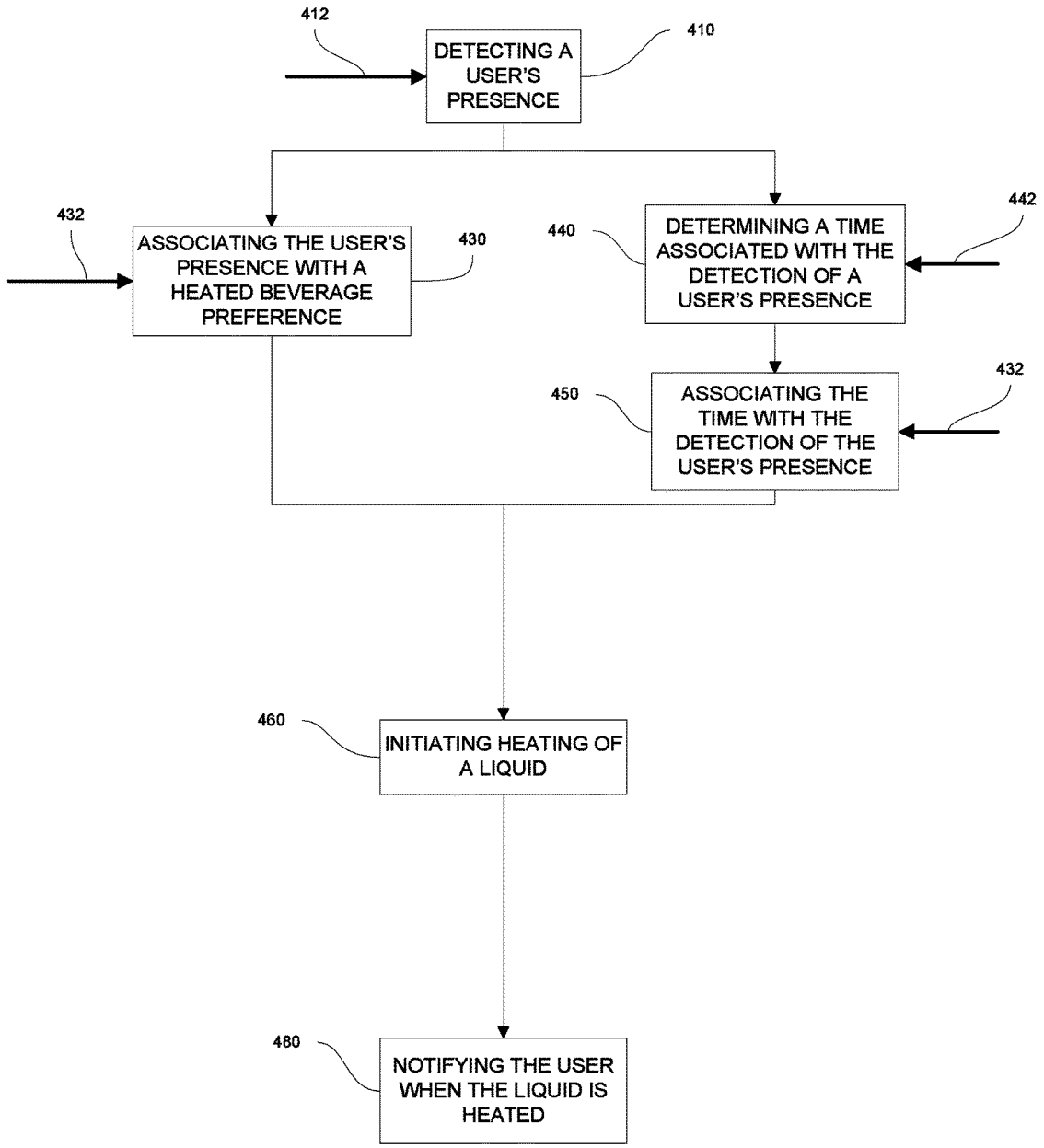
FIG. 6 is a flow chart of a method in accordance with another embodiment of the present disclosure.
Figure 7:
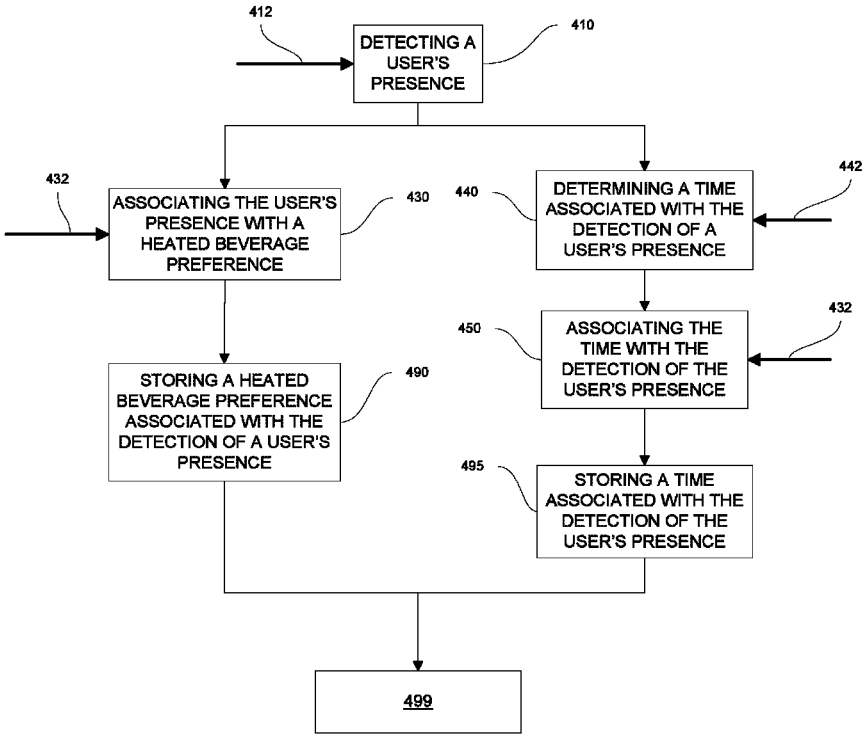
FIG. 7 is a flow chart of a method in accordance with another embodiment of the present disclosure.

For example, and referring now to FIGS. 5 through 7, a method according to the present disclosure may include the step 410 of detecting a user's presence 412. The presence of such user may be an individualized presence, such that the refrigerator appliance 100 distinguishes the user from other users. Such presence detection may be performed in a number of manners. For example, in some embodiments, biometric detection may be utilized, such as via a biometric sensor 414 provided in the refrigerator appliance 100 (see FIG. 1). The biometric sensor 414 may, for example, recognize and distinguish various visual characteristics of individual users, such as facial characteristics. The sensor 414 may thus, for example, include a camera 416 which records images or videos, and may further include suitable biometric software for processing such images or videos. Such camera and software may be in communication with or integral with controller 170, such that controller 170 is operable to detect a user's presence. Suitable examples of such biometric technology may be commercially available from, for example, Cognitec Systems GmbH, with a headquarters in Dresden, Germany, and through, for example, OpenCV.

In other embodiments, audio detection may be utilized, such as via an audio sensor 420 provided in the refrigerator appliance 100 (see FIG. 1). The audio sensor 420 may, for example, recognize and distinguish various audio characteristics of individual users, such as voice characteristics. The sensor 420 may thus, for example, include a microphone 422 which receives and/or records audio transmissions, and may further may further include suitable audio software for processing such transmissions. Such microphone and software may be in communication with or integral with controller 170, such that controller 170 is operable to detect a user's presence. Suitable examples of such audio technology may be commercially available from, for example, Nuance Communications, Inc., with a headquarters in Burlington, Mass.; CSID, with a headquarters in Austin, Tex.; Auraya Systems, with a headquarters in Nashua, N.H.; TradeHarbor, Inc., with a headquarters in St. Louis, Mo.; Voxeo Corporation, with a headquarters in Orlando, Fla.; and AGNITiO Corp, with a headquarters in Arlington, Va.

In other embodiments, radio frequency identification detection ("RFID") or near field communication ("NFC") detection may be utilized, via suitable sensors and readers. An RFID reader 426 or NFC reader 428, for example, may be provided in the refrigerator appliance 100 (see FIG. 1), and a user of the refrigerator appliance may wear or possess an RFID or NFC sensor, conventionally described as a tag (not shown). Sensor reader 426, 428 may be configured for receiving a signal from the sensor. Thus, the reader 426, 428 and sensor can be in signal communication with each other. As an example, the sensor may be a passive tag. Thus, sensor reader 426, 428 can receive a radio signal from such tag in response to a query or request signal from sensor reader 426, 428. In particular, such tag can generate or transmit the response radio signal utilizing energy transmitted, e.g., wirelessly, to the tag from sensor reader 426, 428 via the query or request signal from sensor reader 426, 428. Thus, the tag need not include a battery or other power source in order to generate or transmit the response radio signal. As another example, the tag can include a battery or be connected to a suitable power source, and can continuously or intermittently generate or transmit a signal that sensor reader 426, 428 can receive. As will be understood, sensor reader 426, 428 and the tag can have any other suitable setup or configuration for placing sensor reader 426, 428 and the tag in signal communication with each other. Thus, sensor reader 426, 428 may be passive or active, and the tag may be passive or active depending upon the desired setup.

In still other embodiments, any other suitable detection apparatus may be utilized to facilitate the detection of a user by refrigerator appliance 100. Bluetooth technology is another suitable example of such detection apparatus. In general, suitable detection apparatus facilitates the detection of a user's presence and the distinction of that user's presence from the presences of other users, due to the actual detection of the user's presence or the detection of the presence of device, such as an independent storage device, associated with the user. In exemplary embodiments, controller 170 at least in part performs such detection, utilizing the suitable detection hardware and software provided in the refrigerator appliance 100 and in communication or integral with the controller 170.

A method according to the present disclosure may further, for example, include the step 430 of associating the user's presence 412 with a heated beverage preference 432. For example, one or more heated beverage preferences 432 may be stored in the refrigerator appliance 100, such as in the controller 170 thereof, for each user. Thus, after detection of a user's presence 412, the user's presence 412 may be linked with a certain heated beverage preference 432, such regular coffee, a desired flavor of coffee, decaffeinated coffee, hot water, hot tea, hot chocolate, etc.

In some exemplary embodiments, controller 170 may learn heated beverage preferences 432 for each user 412. For example, upon initial detection of a new user's presence, the controller 170 may monitor the preferences of the user through the user's manual inputs to user interface panel 140. Such preferences may be stored in the controller 170, such that upon later detection of that user's presence, the controller 170 may associate the user's presence with previously detected heated beverage preferences 432. In some embodiments a predetermined number of initial detections and preferences may be utilized, while in other embodiments the controller 170 may continuously learn every time a user's presence is detected.

A method according to the present disclosure may further include, for example, the step 440 of determining a time 442 associated with the detection of a user's presence 412. For example, the controller 170 may be in communication with or integrally include suitable timekeeping apparatus, such as clock and/or calendar software or hardware, for determining time information. A time 442 may thus be determined when a user's presence 412 is detected by refrigerator appliance 100. Time 442 may include a variety of suitable components, including for example the time of day, the day of the week, and other suitable variables. For example, time 442 may include a determination of whether the day is a weekday or weekend-day, or whether the day is a holiday. Further, time 442 may be a specific time or a range of times, such as a multi-hour block during a day.

A method according to the present disclosure may further, for example, include the step 450 of associating the time 442 with the detection of the user's presence 412. For example, upon detection of a user's presence 412, the user's presence 412 may be linked with a certain time 442.

In some exemplary embodiments, controller 170 may learn times 442 for each user 412. For example, upon initial detection of a new user's presence, the controller 170 may monitor the times associated with the detection of such user's presence. Such times 442 may be stored in the controller 170, such that upon later detection of that user's presence, the controller 170 may associate the user's presence with previously detected times 442. In some embodiments a predetermined number of initial detections and times may be utilized, while in other embodiments the controller 170 may continuously learn every time a user's presence is detected.

A method according to the present disclosure may further include, for example, the step 460 of initiating heating of a liquid, such as water, stored in the refrigerator appliance 100. For example, the controller 170 may perform such step, by initiating heating of water in fluid heating assembly 160, such as in the holding chamber 310 thereof by heating element 212. Such initiating step 460 in exemplary embodiments may occur based on the association of a user's presence 412 with a heated beverage preference 432 and/or time 442. For example, controller 170 may include stored therein a particular heated beverage preference 432 for a particular user at a particular time 442. If the user's presence 412 is detected, and for example such presence is detected within the particular time 442 and/or for the particular heated beverage preference 432, the initiating step 460 may occur. Accordingly and advantageously, based on the user's presence associated with a heated beverage preference 432 and/or time 442, preheating of stored liquid such as water may occur before the user interacts manually with the refrigerator appliance 100. Thus, the preheated water is advantageously available to the user quickly, reducing the time period that the user has to wait for a heated beverage.

In some embodiments, as illustrated in FIG. 5, a method according to the present disclosure may further include the step 462 of prompting the user regarding the heated beverage preference 432. For example, upon occurrence of the detecting step 410, the associating step 430, the determining step 440, and/or the associating step 450, the controller 170 may send signals to the user interface panel 140 to prompt the user. The user interface panel 140 may, for example, display a question to the user such as "Steve, would you like me to prepare French Roast Coffee?". The user may respond to this prompt by selecting "Yes" or "No". The prompt may, for example, be based on the user's presence 412 ("Steve", etc.), the associated heated beverage preference 432 ("French Roast Coffee"), and the associated time 442. In these embodiments, the initiating step 460 may occur upon a prompt confirmation ("Yes") by the user, such as that the user does desire a heated beverage, such as the associated heated beverage preference 432.

In other embodiments, as illustrated in FIG. 6, the initiating step 460 may occur automatically after the associating step 430 and/or associating step 450 occur. In these embodiments, a user need not be prompted regarding the heated beverage preference 432, although the user interface panel 140 may display information regarding the user's presence 412, the associated heated beverage preference 432, and the associated time 442.

In some embodiments, as illustrated in FIG. 5 for example, a method according to the present disclosure may further include, for example, the step 470 of releasing a single serve dispenser 200 associated with the heated beverage preference 432. Such releasing step 470 may occur, for example, during or after the initiating step 460. As discussed above and with regard to FIG. 3, the refrigerator appliance 100 may include components for placing single serve dispensers 200 into platforms 222. The releasing step 470 may include activating such components as discussed above, such as through operation of the controller 170, to release a desired and associated single serve dispenser 200. For example, if a French Roast coffee is the heated beverage preference, the controller 170 may operate the supplied release components to move a French Roast coffee single serve dispenser 200 into place and deploy the single serve dispenser 200 as discussed above.

In other embodiments, as illustrated in FIG. 6 for example and as discussed above, no single serve dispensing 200 may be performed. Rather, a user may manually load the desired single serve dispenser 200, as discussed above and with regard to FIG. 2.

In some embodiments, as illustrated in FIGS. 5 and 6, a method according to the present disclosure may further include the step 480 of notifying the user when the liquid is heated. For example, upon occurrence of the initiating step 460, the liquid may be heated as discussed above. Such heating may occur for example until the liquid reaches a predetermined temperature. At this point, heating may cease, and the controller 170 may be notified that the liquid has reached a desired temperature level (which may be an appropriate temperature level for the heated beverage preference 432). The controller 170 may thus operate to notify the user that the liquid is heated, such as by sending signals to the user interface panel 140 to display such notification. Upon receipt of this notification, the user may be free to manually interact with the user interface panel 140 to dispense heated liquid, such as through heated water outlet 150 and/or outlet conduit 210. In alternative embodiments, the heated liquid may automatically dispense, with or without a user notification. Automatic dispensing may, for example, occur when a cup or other container for receiving the liquid is detected.

Referring to FIG. 7, a method and refrigerator appliance 100 according to the present disclosure may further include various steps for storing certain information as disclosed herein. For example, in some embodiments, a method according to the present disclosure may include the step 490 of storing a heated beverage preference 432 associated with the detection of a user's presence 412 and/or the step 495 of storing a time 442 associated with the detection of the user's presence 412. In some exemplary embodiments, such user preference information may be stored in controller 170. In other embodiments, as illustrated in FIG. 7, such user preference information may be stored in an independent storage device 499. Further, the device 499 may be in communication with the controller 170, such that the information is transmittable between the controller 170 and device 499. This further allows the device 499 to be utilized with multiple refrigerator appliances 100 such that a user's preferences may be learned by one refrigerator appliance 100 and then utilized with another refrigerator appliance 100. Such communication may be facilitated through, for example, a suitable wired or wireless connection. In some embodiments, a device 499 may be, for example, an independent device such as a "dongle" that the user carries with him/her. In other embodiments a device 499 may be a component of another suitable device that the user carries with him/her, such as a cellular phone, etc. In still other embodiments, a device 499 may be a digital storage drive, such as a "cloud"-based storage.

As discussed above, the present disclosure is further directed to refrigerator appliances 100 which perform the various steps as discussed herein. Controller 170 in exemplary embodiments may, at least in part, be capable of performing such steps. The present disclosure thus advantageously provides methods and apparatus which facilitate at least partially automated and improved liquid preheating in refrigerator appliances 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a refrigerator appliance, the method comprising:

detecting a user's presence;

associating the user's presence with a heated beverage preference; and initiating heating of a liquid stored in the refrigerator appliance, wherein the detecting step, the associating step and the initiating step are performed by a controller of the refrigerator appliance, and wherein the initiating step occurs automatically in response to the associating step without an additional user prompt.

2. The method of claim 1, further comprising storing the heated beverage preference associated with the detection of the user's presence.

3. The method of claim 1, further comprising releasing a single serve dispenser associated with the heated beverage preference.

4. The method of claim 1, wherein the detecting step utilizes one of biometric detection, audio detection, radio frequency identification detection, or near field communication detection.

5. The method of claim 1, further comprising notifying the user when the liquid is heated.

6. The method of claim 1, further comprising:

determining a time associated with the detection of the user's presence; and associating the time with the heated beverage preference.

7. The method of claim 6, further comprising storing the time associated with the detection of the user's presence.

8. A method for operating a refrigerator appliance, the method comprising:

detecting a user's presence;

determining a time associated with the detection of the user's presence;

associating the user's presence and the time with a heated beverage preference;

initiating heating of a liquid stored in the refrigerator appliance; and storing the heated beverage preference and the time associated with the detection of the user's presence, wherein the detecting step, the determining step and the associating step are performed by a controller of the refrigerator appliance, and wherein the initiating step occurs automatically in response to the associating step without an additional user prompt.

9. The method of claim 8, wherein the heated beverage preference and the time associated with the detection of the user's presence are stored in the controller.

10. The method of claim 8, wherein the heated beverage preference and the time associated with the detection of the user's presence are stored in an independent storage device.

11. A method for operating a refrigerator appliance, the method comprising:

detecting a user's presence utilizing biometric detection, audio detection, radio frequency identification detection, or near field communication detection;

determining a time associated with the detection of the user's presence;

associating the user's presence with a heated beverage preference;

associating the time with the heated beverage preference;

initiating heating of a liquid stored in the refrigerator appliance; and releasing a single serve dispenser automatically, the single serve dispenser being associated with the heated beverage preference, wherein the detecting step, the associating step and the initiating step are performed by a controller of the refrigerator appliance, and wherein the initiating step occurs automatically in response to the associating step without an additional user prompt.

12. The method of claim 11, further comprising automatically notifying the user when the liquid is heated.

13. The method of claim 11, further comprising releasing a single serve dispenser associated with the heated beverage preference.

14. The method of claim 11, wherein the detecting step utilizes one of biometric detection, audio detection, radio frequency identification detection, or near field communication detection.

* * * * *